United States Patent [19]

Vaccari

[11] 4,232,459

[45] Nov. 11, 1980

[54] SKI BOOTS

[76] Inventor: Franco Vaccari, Via Paleoveneti 3/3, Montebelluna, Treviso, Italy

[21] Appl. No.: 956,294

[22] Filed: Oct. 30, 1978

[30] Foreign Application Priority Data

Nov. 2, 1977 [IT] Italy ..... 22634/77[U]

[51] Int. Cl.[3] ..... A43B 19/00; A43B 7/06

[52] U.S. Cl. ..... 36/71; 36/3 R

[58] Field of Search ..... 36/71, 117, 3 R, 3 A, 36/3 B

[56] References Cited

U.S. PATENT DOCUMENTS

| | | | |
|---|---|---|---|
| 2,774,152 | 12/1956 | Alber | 36/71 |
| 3,664,043 | 5/1972 | Polumbos | 36/71 |

FOREIGN PATENT DOCUMENTS

| | | | |
|---|---|---|---|
| 2316014 | 11/1973 | Fed. Rep. of Germany | 36/71 |

*Primary Examiner*—Patrick D. Lawson

*Attorney, Agent, or Firm*—Guido Modiano; Albert Josif

[57] ABSTRACT

A ski boot comprises, between the shell and the inshoe, a bladder (1) connected to a resilient chamber (2) incorporated in the ski boot and connected by an air delivery conduit (5) to the bladder (1), in such a way as to cause the position of the resilient chamber to be independent from the position and configuration of the bladder.

3 Claims, 4 Drawing Figures

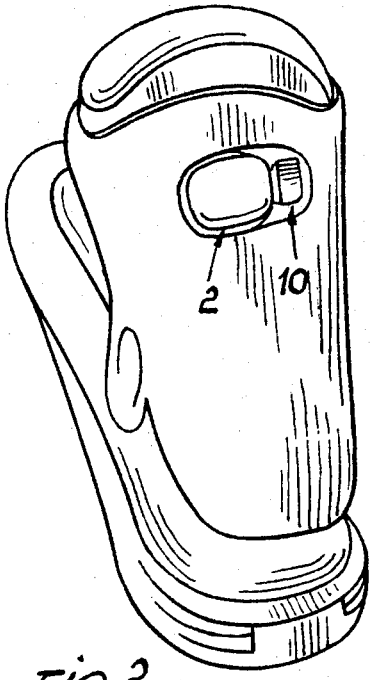
Fig.2
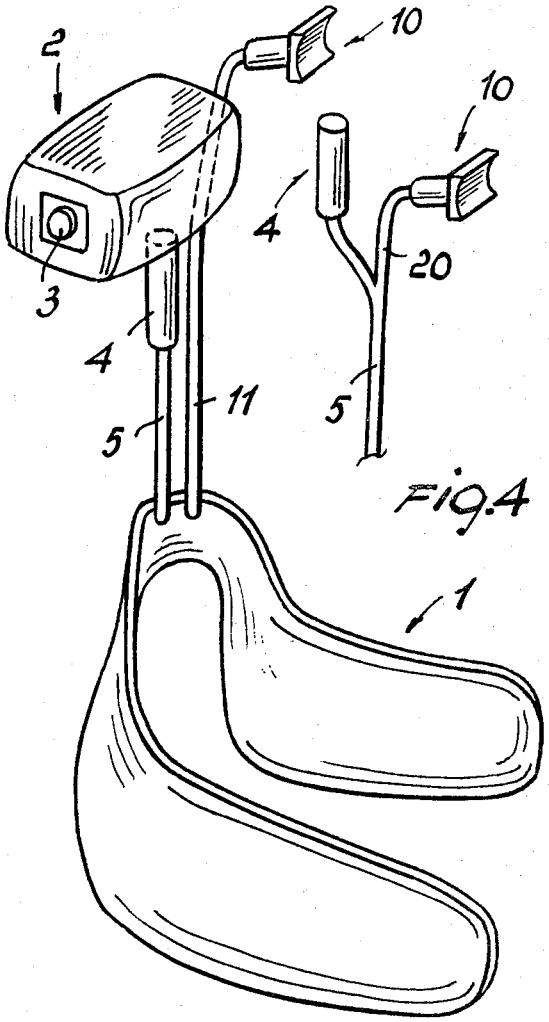
Fig.4
Fig.3
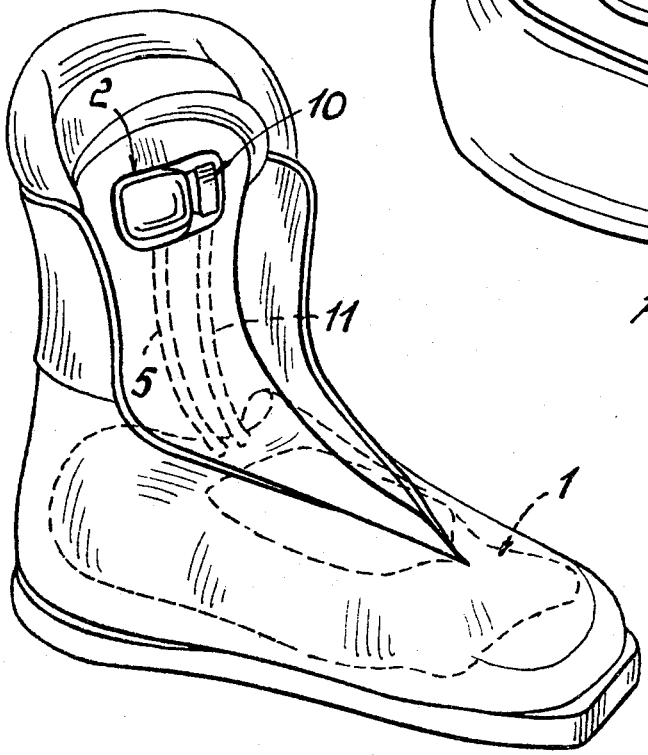
Fig.1

SKI BOOTS

BACKGROUND OF THE INVENTION

This invention relates to ski boots.

At present there are various types of ski boots available, generally of plastics construction, which are fastened by a so-called "pneumatic" device.

For this purpose, the inside of the boot comprises bladder members which are inflated by the user after putting on the boot, so as to firmly lock the foot inside the boot.

The air is fed into the bladder members by pumping members connected to suitable delivery and vent valves, which can be removably connected to the bladder members or can be directly incorporated in the boot.

The present invention relates to fastening devices with the pumping means incorporated in the boots, and it is to these latter that the description refers.

In fastening devices with pumping means incorporated in the boot, the bladder member is directly connected to the pumping means by way of an air delivery valve. This solution considerably limits the designer, in that the configuration and positioning of the bladder member is a direct function of the point in which the pumping means are to be positioned on the shell.

The solution is obviously a source of numerous drawbacks and serious limitations, in that sometimes the most comfortable and handy positioning for the pumping means corresponds to the configuration and position of the bladder member.

SUMMARY OF THE INVENTION

One object of the present invention is to obviate the aforesaid drawbacks by providing a fastening device for ski boots constructed in such a manner as to make the positioning of the pumping means and the positioning of the bladder member independent of each other.

A further object of the present invention is to provide a fastening device for ski boots in which the position of the pumping means relative to the bladder member can be varied as required, without creating any constructional problem.

A further object of the present invention is to provide a fastening device for ski boots which is easy to construct from commercially obtainable components, and which is highly competitive from the cost aspect.

According to the invention these and further objects which will be apparent hereinafter, are attained by a ski boot, comprising a bladder member positionable between the shell and the inshoe, and connected to pumping means incorporated in the ski boot, wherein said pumping means are connected to said bladder member by an air delivery conduit, air discharge means being provided, connected to said bladder member.

BRIEF DESCRIPTION OF THE DRAWINGS

Further characteristics and advantages will be more apparent from the detailed description of one embodiment of a ski boot illustrated by non-limiting example in the accompanying drawing, in which:

FIG. 1 is a diagrammatic perspective view of a ski boot with the pumping means positioned in the front nose of the quarter;

FIG. 2 shows a ski boot with the pumping means disposed at the rear;

FIG. 3 is a diagrammatic view of the pumping means fitted to a bladder member;

FIG. 4 is a diagrammatic view of the branch connection for the discharge means from the air delivery conduit.

DESCRIPTION OF A PREFERRED EMBODIMENT

With reference to said figures, a ski boot, according to the invention, comprises a bladder member indicated overall by the reference numeral 1, which can be of any configuration according to requirements, and can be positioned at will in any point of the boot, preferably between the shell and the inshoe of the ski boot.

Said bladder member is connected to pumping means, which are incorporated within the shell of the ski boot and are preferably but not necessarily constituted by a resilient chamber 2 comprising a suction valve 3 and a delivery valve 4. The resilient chamber 2 can have any configuration and construction, according to its positioning and according to circumstances. The only requirement is that it must be compressible in order to deliver air, and must be resilient in order to suck air through the suction valve 3.

As shown in FIGS. 1 and 2, the position of the pumping means can be easily changed, this position being that which is most comfortable and suitable in accordance with the type of ski boot and its use.

The fundamental characteristic of the invention is that the connection between the pumping means 2 and bladder member 1 is made by means of an air delivery conduit indicated by 5, which develops between the inshoe and the shell of the ski boot (as deducible by dotted lines representing conduit 5 in FIG. 1) and which connects the pumping means and bladder member together through the delivery valve 4.

This means that the position of the pumping means is not dependent on the position and configuration of the bladder member 1. This is because the delivery conduit 5 enables the pumping means 2 and bladder member 1 to be connected together even if they are not positioned to correspond with each other in the ski boot.

Obviously the length of the air delivery conduit 5 can be chosen at will according to the distance between the pumping means 2 and bladder member 1.

The fastening device also comprises air discharge means which enable air to be discharged from the bladder member 1 when the boot is to be removed from the foot.

Said discharge means are constituted by a vent or discharge valve indicated by 10, which as shown in FIG. 3 is connected by a discharge conduit 11 directly to the bladder member 1, so as to enable the pumping means 2 and vent valve 10 to be positioned side by side with the shell of the ski boot, for example as shown diagrammatically in FIG. 1. Also conduit 11 develops between the inshoe and the shell of the ski boot (FIG. 1).

It is also obviously possible to position the discharge means separately from the pumping means by directly connecting the discharge means to the bladder member 1.

FIG. 4 shows another method of positioning the discharge means, in which the discharge means are connected to the delivery conduit 5 by a branch conduit 20.

The use of the fastening device is apparent from the description given heretofore. When the user has put the boot on, he merely has to inflate the bladder member 1 to the required pressure by operating the resilient chamber 2, which compresses the air contained therein so that it is fed into the bladder member 1 through the delivery valve 4 and delivery conduit 5. When released, the resilient chamber again sucks air from the outside through the suction valve 3 and into the chamber 2, and the movement is repeated until the required pressure has been attained and the user has fastened the boot to the preferred extent.

When the boot is to be removed, the vent valve 10 is operated from outside of the shell of the ski boot to discharge air from the bladder member and thus release the foot from the pressure action exerted by the bladder member 1.

From the aforegoing description it can be seen that the invention attains the required objects, and in particular it is emphasized that the presence of the delivery conduit 5 enables the bladder member 1 and pumping means 2 to be positioned independently of each other. This makes it possible to construct the bladder member 1 in the most suitable shape and to locate it in the most suitable position, while at the same time locating the pumping means in a position easily accessible by the user.

In practice the materials used and dimensions and shapes can be chosen at will according to requirements.

I claim:

1. A ski boot comprising a shell, an inshoe within said shell, a bladder member between said shell and said inshoe, pumping means incorporated within said shell, a delivery valve between said pumping means and said bladder member for delivering air from said pumping means to said bladder member, and means for discharging air from said bladder member, wherein said bladder member is connected with said pumping means and said discharge means through conduits developing between said inshoe and said shell.

2. A ski boot as claimed in claim 1, wherein said air discharging means comprise a discharge valve separate from said pumping means and housed within said shell to be operable from outside of said shell, said bladder member being connected to said pumping means and said discharge valve through separate conduits.

3. A ski boot as claimed in claim 1, wherein said conduits comprise a delivery conduit connecting said pumping means with said bladder member and a branch conduit connecting said discharge means with said delivery conduit.

* * * * *